United States Patent [19]

Vickery et al.

[11] Patent Number: 4,661,056

[45] Date of Patent: Apr. 28, 1987

[54] TURBULENT INCINERATION OF COMBUSTIBLE MATERIALS SUPPLIED IN LOW PRESSURE LAMINAR FLOW

[75] Inventors: Earl Vickery, San Jose; Mark Yates, Morgan Hill, both of Calif.

[73] Assignee: American Hoechst Corporation, Somerville, N.J.

[21] Appl. No.: 839,668

[22] Filed: Mar. 14, 1986

[51] Int. Cl.[4] ..... F23D 14/00; F23G 7/08; F23J 15/00

[52] U.S. Cl. ..... 431/5; 110/212; 110/213; 110/214; 110/215; 431/202; 432/182

[58] Field of Search ..... 431/5, 202, 353, 263; 110/210, 211, 212, 213, 214, 215; 423/182

[56] References Cited

U.S. PATENT DOCUMENTS

| | | | |
|---|---|---|---|
| 2,480,230 | 8/1949 | Elster | 431/263 X |
| 3,086,851 | 4/1963 | Wagner . | |
| 3,248,178 | 4/1966 | Hoskinson . | |
| 3,261,008 | 7/1966 | Schreter et al. | 431/66 X |
| 3,606,611 | 9/1971 | Wright | 431/5 X |
| 3,893,810 | 7/1975 | Lientz | 431/5 X |
| 3,917,796 | 11/1975 | Ebeling . | |
| 3,985,494 | 10/1976 | Childree . | |
| 3,993,449 | 11/1976 | Childs | 431/5 X |
| 4,018,879 | 4/1977 | Winnen . | |
| 4,144,313 | 3/1979 | Germerdonk et al. . | |
| 4,152,399 | 5/1979 | Germerdonk et al. . | |
| 4,215,095 | 7/1980 | Harris et al. . | |
| 4,228,261 | 10/1980 | Scholten et al. . | |
| 4,230,580 | 10/1980 | Dodson . | |
| 4,269,806 | 5/1981 | Yaguchi et al. | 110/215 X |
| 4,276,063 | 6/1981 | Lackey et al. . | |
| 4,499,945 | 2/1985 | Hill et al. . | |
| 4,503,092 | 3/1985 | Klebe et al. . | |
| 4,519,999 | 5/1985 | Coleman et al. . | |
| 4,555,389 | 11/1985 | Soneta et al. . | |

FOREIGN PATENT DOCUMENTS

| | | |
|---|---|---|
| 0044903 | 3/1982 | European Pat. Off. . |
| 48-08688 | 2/1973 | Japan . |
| 0021994 | 8/1975 | Japan . |

*Primary Examiner*—Edward G. Favors
*Attorney, Agent, or Firm*—Richard S. Roberts

[57] ABSTRACT

An apparatus and method for incinerating combustible gases. The apparatus has first and second perpendicularly joined pipes and an igniter in the second pipe. Combustible gases laminarly flow into the second pipe and oxygen turbulently flows into the first. The gases turbulently mix, ignite and centrifugally swirl from the first pipe to the second pipe and then out the first pipe again. Fuel flow is regulated by flame, temperature and seismic detectors.

19 Claims, 1 Drawing Figure

TURBULENT INCINERATION OF COMBUSTIBLE MATERIALS SUPPLIED IN LOW PRESSURE LAMINAR FLOW

BACKGROUND OF THE INVENTION

The present invention relates to a system for the incineration of combustible gases in a reaction chamber wherein the gas is introduced into the reactor in a low pressure laminar flow state. More particularly, the invention relates to a method of incinerating waste gases from industrial processes by substantially converting them to relatively non-polluting, low temperature products of combustion. Still more particularly, the invention relates to a means for combusting pyrophoric silane waste products from epitaxial or other reactors which are used in the manufacture of semiconductors.

Methods of incinerating gaseous waste products have been known heretofore. Generally, such have suffered from the disadvantage that substantially complete combustion of the vent gas has not been achieved, thereby allowing the release of pollutants to the atmosphere, or products of combustion result at unacceptably high temperatures. Also, the release of pyrophoric materials such as silanes is very dangerous since they may spontaneously ignite uncontrolledly when mixed with air. Further, apparatus for carrying out prior methods for incinerating streams of combustible vent gas are often relatively expensive to install and operate. In these cases, the waste gases are introduced into a reaction chamber under relatively high pressure either via pumping or nozzle means in order to intimately mix with incoming air for subsequent ignition. Such high pressure systems are not suitable for some industrial processes. For example, in the manufacture of semiconductors, silane gas along with other components such as phosphine and arsine are conducted over silicon wafers for reaction therewith. In order to assure a highly uniform wafer, the reactants are introduced at about atmospheric pressure or very slightly above atmospheric pressure which is sufficient only to insure flow into the reactor. Waste gases from this reactor exit at essentially the same rate as the inflow. Inflow is naturally laminar to assure uniformity of production and therefore waste gases exit through appropriate piping in a laminar fashion. Should the exit flow be subsequently constricted, for example via a nozzle, to raise the velocity of exiting gases to induce turbulent flow for mixture with air, then an unacceptable back pressure would be induced upstream in the silane/silicon wafer reactor. Furthermore, it is theorized, that when turbulent silane gas is admixed with air it is atomized thus forming a protective invisible bubble of silicon dioxide around molecular silane. When this bubble is burst in uncontrolled surroundings, it reacts with air explosively with much resultant property damage or even death. The present invention either effectively prevents bubble formation or shears these bubbles open in a controlled combustion chamber and ignites the silane gas to form relatively harmless and non-polluting oxides of silicon.

SUMMARY OF THE INVENTION

Figure 1:
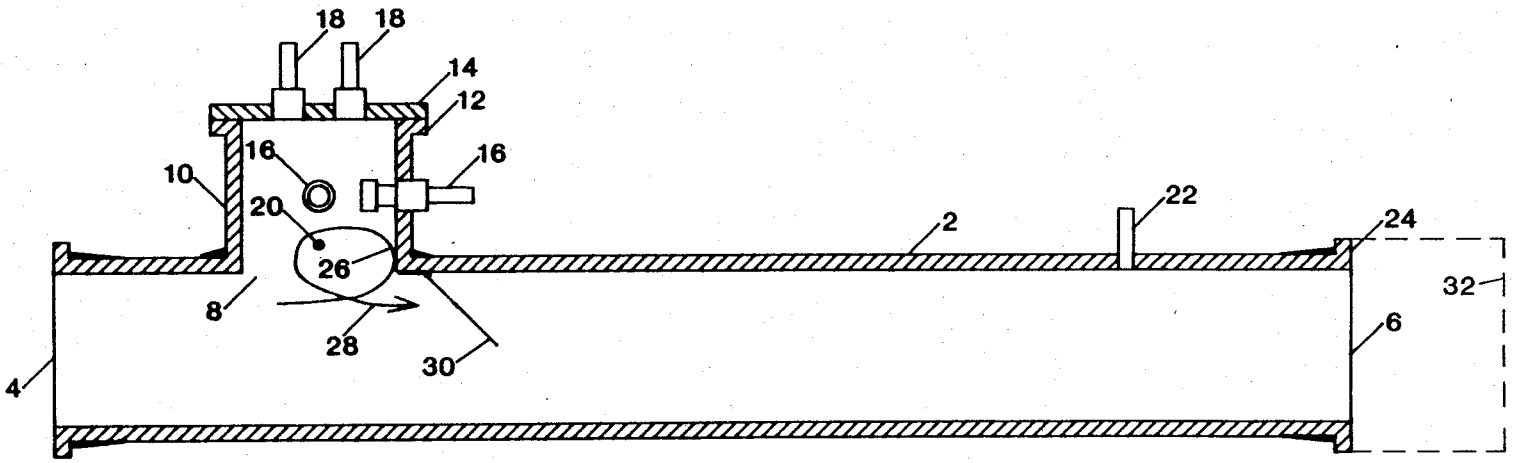
FIG. 1 is a cross-sectioned elevational view of the apparatus of the present invention.

The invention provides an apparatus for incinerating combustible gases which comprises:

(a) a first pipe member having open entrance and exit end portions and an inlet opening through the wall thereof intermediate said end portions;

(b) a second pipe member having first and second ends, said first end being fixed about said inlet to provide a means of ingress and egress between said pipe members, said second end being substantially closed to its surroundings;

(c) ignition means disposed within said second pipe portion;

(d) means for conducting a laminar flow of at least one combustible gas into said second pipe portion; and (e) means for turbulently flowing a stream of a gas capable of supporting combustion into the entrance end of said first pipe member, then centrifugally swirling said turbulent gas flow into and out of said second pipe member through said inlet, and then discharging said turbulent gas flow through the exit end of said first pipe member.

The invention further provides a method for incinerating combustible gases which comprises:

(a) providing an apparatus comprising (i) a first pipe member having open entrance and exit end portions and an inlet opening through the wall thereof intermediate said end portions; and (ii) a second pipe member having first and second ends, said first end being fixed about said inlet to provide a means of ingress and egress between said pipe members, said second end being substantially closed to its surroundings; and (iii) ignition means disposed within said second pipe portion;

(b) conducting a laminar flow of at least one combustible gas into said second pipe portion; and (c) turbulently flowing a stream of a gas capable of supporting combustion into the entrance end of said first pipe member, then centrifugally swirling said turbulent gas flow into and out of said second pipe member through said inlet while causing said combustible gas to ignite in said second pipe member; and then discharging said gas flow through the exit end of said first pipe member.

DETAILED DESCRIPTION OF THE PREFERRED EMBODIMENT

The invention provides an apparatus for incinerating combustible gases, particularly gases which are pyrophoric. The invention is particularly suitable for burning a mixture of hydrogen and silane gases which also contains waste dopants such as arsine and phosphine which are useful in the manufacture of semiconductor devices.

The preferred apparatus is shown in FIG. 1. It comprises a first pipe member 2 having open entrance and exit ends 4 and 6 respectively. Between these ends is an inlet 8. Attached about this inlet is a second pipe member 10 which is open on the end which attaches to the aforementioned inlet 8. In the preferred embodiment the pipe members are perpendicularly attached by suit means such as welding. Second pipe member 10 is substantially closed to its surroundings at its opposite end 12. In one form of the invention this closure is achieved by means of a cover plate 14 which is suitably attached, for example by bolts, which are not shown. Both pipes and cover plates should be made of drawn carbon steel. Attached through a side wall of the second pipe member is a means of ignition 16. In the preferred embodiment this means is one or more spark plugs, preferably having a platinum tip which catalyzes the ignition of the fuel gases. Such fuel gases are supplied by flowing them into the second pipe via appropriate tubing 18. Means 20 and 22 may also be provided to detect ignition and temperature respectively in the apparatus. Such flame and temperature detectors are well known to the skilled artisan.

In operation, entrance end 4 supplies a source of a turbulently flowing gas capable of supporting combustion. Usually this is merely atmospheric air, although any oxygen source is also suitable. In the preferred embodiment, exit end 6 is connected via flange 24 to a standard commercial scrubber 32. The scrubber turbulently draws the air through the pipe 2 from entrance 4 via a sucking action. The fuel gases preferably flow into pipe 10 through tubes 18 in a very low pressure laminar fashion In semiconductor manufacturing activities doped silane gases, for example in epitaxial reactors, must flow into the reactor very gently and under a very low pressure to assure uniformity of the process. Pressures are normally held at slightly above atmospheric pressure so as to provide a very small amount of forward flow. A typical forward pressure is one atmosphere $\pm\frac{1}{2}$ inch of water. Therefore, in order to maintain this constant pressure in the reactor, waste gases must flow into tube 18 at essentially the same pressure in order to avoid back pressure upstream. In order to assure a uniform mixture, fuel gases in laminar flow through take 18 are mixed with turbulently flowing air which enters through opening 4. It has been found that when high velocity air flowing through pipe 2 reaches inlet 8, it meets with low velocity gases in pipe 2. A portion of the air therefore enters inlet 8, hits the side wall of pipe 10 at point 26 and centrifugally swirls in the direction of arrow 28. In a preferred embodiment, the gases which flow through tubes 18 are at least combustible and are usually pyrophoric. Since pyrophoric gases ignite spontaneously when contacted by air a separate ignition source might not normally seem necessary. However, to assure combustion, the invention provides ignition means 16 as added reliability for the apparatus. Furthermore, when merely combustible gases such as hydrogen are used, an ignition source certainly is desired, if not necessary. To add further reliability to the apparatus, the ignition spark plug 16 may be provided with a platinum tip to catalyze ignition when hydrogen gas is used. Still more preferably at least two such spark plugs are desired to add an extra measure of reliability of ignition.

Without intending to be bound by a particular theory, silane gases, while known to be pyrophoric and hence ignite in the presence of air, do not always ignite immediately on such exposure. It is believed that when silane gas is exposed to oxygen in the air, certain oxides of silicon are produced which form a protective bubble. Silane gas then fills this bubble much like a balloon. This protective bubble prevents oxygen from reaching the silane continuously for ignition. When this enlarged bubble eventually breaks, a large amount of silane is exposed to oxygen precipitously and a violent explosion may occur. By means of the present invention, it is believed that the centrifugal swirling action of the turbulently flowing oxygen shears the silane bubbles and permits essentially complete combustion before any explosive build up can occur. In carrying out combustion, ignition and burning are conducted primarily within pipe member 10 where a swirling flame is induced. The flame is then directed down pipe 2 in the direction of arrow 28. In the preferred embodiment, a baffle 30 is provided as a flame director in order to guide the produced flame down along the longitudinal axis of pipe 2 and thus to avoid the inside wall of pipe 2 to the extent possible. In operation the flame actually does not travel much beyond the end of the baffle and the long pipe length as well as an excess supply of incoming air serves as a heat sink to cool down the temperature of exhaust gases to a considerable extent. In fact the gases passing through exit 6 are preferably less than one hundred degrees Celsius and can certainly be safely treated by a commercial scrubber.

As further safety features, the supply of fuel gas from tubes 18 may be regulated by a series of sensors. These may include a flame sensor within pipe 10, a temperature sensor within pipe 22 and a seismic disturbance sensor. For example, fuel flow maybe cut off if the flame is extinguished, the temperature rises outside desirable limits or seismic activity is noted. Each of these sensor types are well known in the art. Such sensors may cause the appropriate electrical signals to travel to a relay which closes off or reduces fuel gas flow. The overall system may be provided with an appropriate control panel which includes temperature monitoring, flame detection, fuel and air flow measurement, alarms, start, stop, and reset controls and the like.

While there have been described herein what are at present considered preferred embodiments of the invention, it will be obvious to those skilled in the art that modifications and changes may be made therein without departing from the essence of the invention. It is therefore to be understood that the exemplary embodiments are illustrative and not restrictive of the invention, the scope of which is defined in the appended claims, and that all modifications that come within the meaning and range of equivalency of the claims are intended to be included therein.

What is claimed is:

1. An apparatus for incinerating combustible gases which comprises:

(a) a first pipe member having open entrance and exit end portions and an inlet opening through the wall thereof intermediate said end portions;

(b) a second pipe member having first and second ends, said first end being fixed about said inlet to provide a means of ingress and egress between said pipe members, said second end being substantially closed to its surroundings;

(c) ignition means disposed within said second pipe portion;

(d) means for conducting a laminar flow of at least one combustible gas into said second pipe portion; and (e) means for turbulently flowing a stream of a gas capable of supporting combustion into the entrance end of said first pipe member, then centrifugally swirling said turbulent gas flow into and out of said second pipe member through said inlet, and then discharging said turbulent gas flow through the exit end of said first pipe member.

2. The apparatus of claim 1 wherein said ignition means comprises a spark plug.

3. The apparatus of claim 2 wherein said spark plug has an ignition tip which comprises platinum.

4. The apparatus of claim 1 wherein said element (d) comprises at least one tube through a wall of said second pipe member.

5. The apparatus of claim 4 wherein said element (d) comprises means for regulating gas flow through said tube.

6. The apparatus of claim 1 further comprising flame directing baffle means between said inlet, and said exit end capable of directing ignited gas in a direction along the longitudinal axis of said first pipe member toward said exit end.

7. The apparatus of claim 1 further comprising ignition detecting means within said second pipe member.

8. The apparatus of claim 1 further comprising temperature detecting means within said first pipe member.

9. The apparatus of claim 5 wherein said means for regulating gas flow is regulated by ignition detecting means within said second pipe member and/or said temperature detecting means within said fist pipe member.

10. The apparatus of claim 5 wherein said means for regulating gas flow comprises means responsive to seismic disturbances.

11. A method for incinerating combustible gases which comprises:

(a) providing an apparatus comprising (i) a first pipe member having open entrance and exit end portions and an inlet opening through the wall thereof intermediate said end portions; and (ii) a second pipe member having first and second ends, said first end being fixed about said inlet to provide a means of ingress and egress between said pipe members, said second end being substantially closed to its surroundings; and (iii) ignition means disposed within said second pipe portion;

(b) conducting a laminar flow of at least one combustible gas into said second pipe portion; and (c) turbulently flowing a stream of a gas capable of supporting combustion into the entrance end of said first pipe member, then centrifugally swirling said turbulent gas flow into and out of said second pipe member through said inlet while causing said combustible gas to ignite in said second pipe member; and then discharging said turbulent gas flow through the exit end of said first pipe member.

12. The method of claim 11 wherein said combustible gas comprises hydrogen.

13. The method of claim 11 wherein said combustible gas comprises silane.

14. The method of claim 12 wherein said combustible gas comprises silane.

15. The method of claim 11 wherein said gas capable of supporting combustion comprises oxygen.

16. The method of claim 11 wherein said gas capable of supporting combustion comprises air.

17. The method of claim 11 further comprising causing the gas flow through said exit end to subsequently flow through a scrubber.

18. The apparatus of claim 1 wherein element (e) comprises a scrubber.

19. The method of claim 11 wherein said turbulently flowing stream of a gas capable of supporting combustion is caused by a scrubber.

* * * * *